US005282768A

United States Patent [19]

Akman

[11] Patent Number: 5,282,768

[45] Date of Patent: Feb. 1, 1994

[54] BALLOON DISPLAY DEVICE AND METHOD

[76] Inventor: Alp T. Akman, 1195-A Linda Vista Dr., San Marcos, Calif. 92069

[21] Appl. No.: 810,907

[22] Filed: Dec. 20, 1991

[51] Int. Cl.[5] ..... A63H 27/10

[52] U.S. Cl. ..... 446/220; 446/221; 446/222

[58] Field of Search ..... 446/220–226

[56] References Cited

U.S. PATENT DOCUMENTS

| | | | |
|---|---|---|---|
| 1,077,735 | 11/1913 | Morinaga | 446/225 |
| 1,707,714 | 4/1929 | Dvilnsky | 446/220 |
| 2,542,361 | 2/1951 | Roxburgh | 446/220 X |
| 2,826,000 | 3/1958 | Fischman et al. | 446/223 X |
| 2,927,383 | 3/1960 | Longino | 446/222 X |
| 4,463,513 | 8/1984 | Wallace | 446/222 |
| 4,934,986 | 6/1990 | Wallace | 446/222 |
| 4,997,403 | 3/1991 | Akman | 446/220 |

FOREIGN PATENT DOCUMENTS

| | | | |
|---|---|---|---|
| 815917 | 10/1951 | Fed. Rep. of Germany | 446/220 |

*Primary Examiner*—Mickey Yu
*Attorney, Agent, or Firm*—Calif Tervo

[57] ABSTRACT

An inflated elastic balloon has a tube passing completely therethrough. The tube is used to connect a plurality of balloons in a display pattern and to introduces a string of lights into the balloon interiors for display purposes. A disk having a bore is depressed into a deflated balloon wall and the wall covering the bore has a small hole or orifice in it. The tube passes through the disk bore and the wall orifice. A collar secures the balloon wall to the disk such that the wall material surrounding the wall orifice remains elastic and forms a sliding seal against the tube upon passage therethrough. In an alternate embodiment, the disk bore includes constriction rings that form a sliding seal against the tube and the balloon wall is secured and sealed against the disk. The method of passing a tube in sealed relationship through a wall of an inflatable balloon comprises the steps of inserting the disk into a deflated balloon through the balloon neck, depressing the disk first side into the deflated balloon elastic wall, securing the wall to the disk such that the balloon wall portion covering the disk bore essentially will not be expanded upon balloon inflation, making an orifice in the balloon wall portion covering the disk bore, and inserting the tube through the balloon wall orifice and disk bore.

20 Claims, 1 Drawing Sheet

FIG. 1
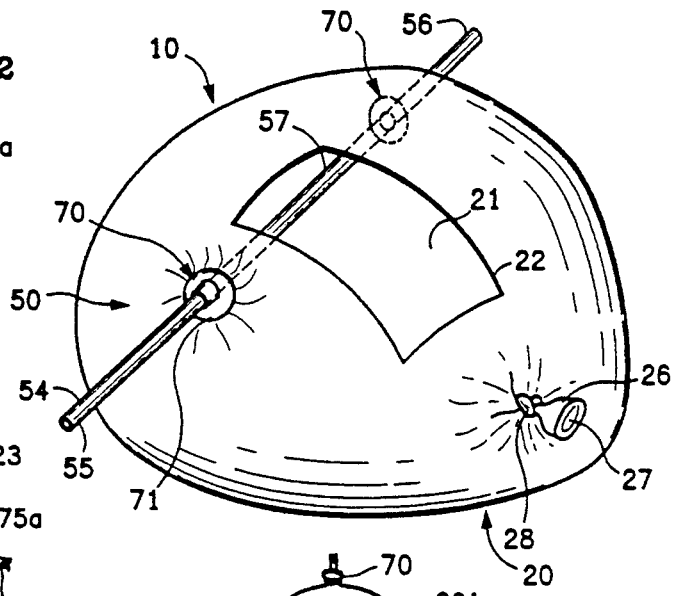
FIG. 2
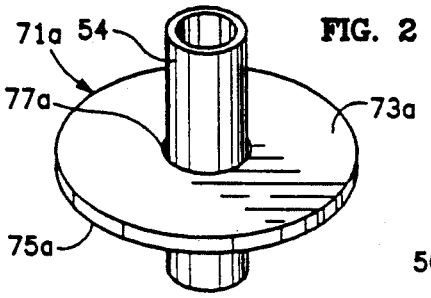
FIG. 3
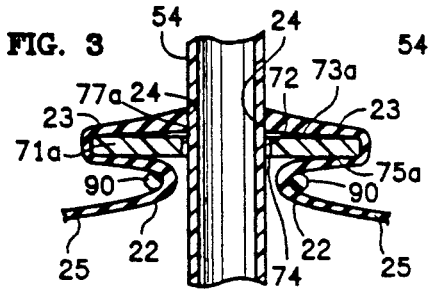
FIG. 4
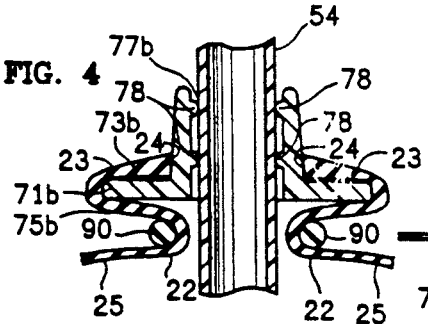
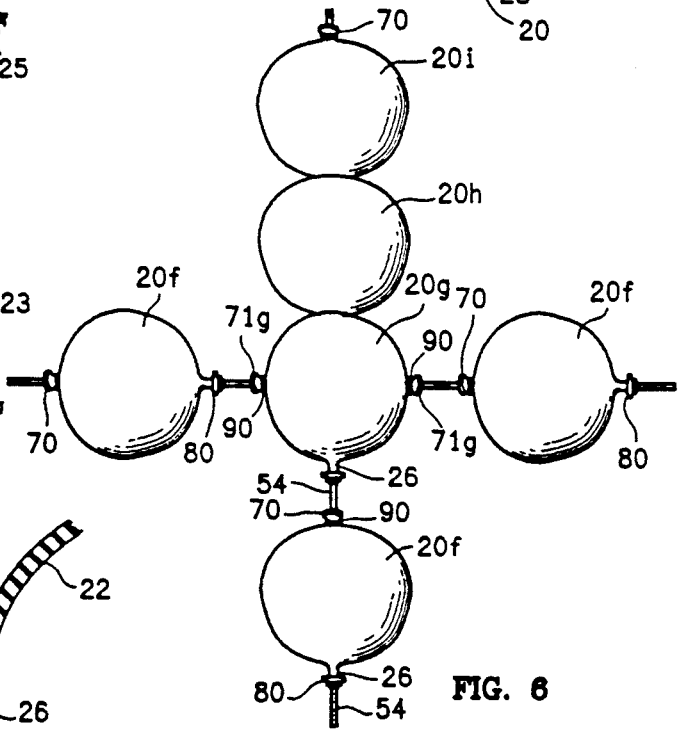
FIG. 6
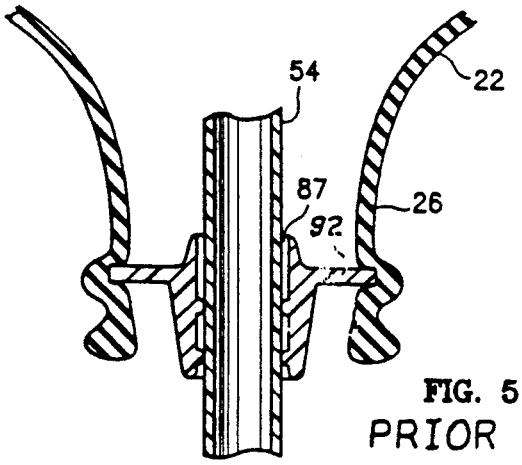
FIG. 5
PRIOR ART

BALLOON DISPLAY DEVICE AND METHOD

BACKGROUND OF THE INVENTION

1. Field of the Invention

This invention relates in general to a balloon display device and more specifically involves an elastic inflatable balloon having a tube passing completely therethrough. The transit tube may join a multitude of balloons and functions as a conduit, for example for a string of display lights.

2. Background of the Invention

Inflatable balloons have long been used as display devices. For example, U.S. Pat. No. 4,934,986 of Wallace titled "Balloons Connected Together" describes a device for connecting a multiplicity of balloons together into a display.

A balloon lighted from the inside produces a very attractive display, particularly when seen in low light conditions. My previous patent, U.S. Pat. No. 4,997,403, describes a balloon lighting device for positioning a light at any position inside of an inflated balloon.

SUMMARY OF THE INVENTION

This invention is a balloon display device and it generally comprises an inflated elastic balloon having a tube passing completely therethrough. The tube is used to connect a plurality of balloons in a display pattern and to conduct materials, such as a string of lights, through the balloon interiors for display purposes.

The balloon comprises a wall of elastically expansible material formed into a closed shape so as to define an expansion chamber. A tube assembly includes the tube and tube wall passage means for passage of the tube in a sealed relationship through the balloon wall. The wall passage means includes a disk having a first side, a second side, and a bore therebetween for passage of the tube. The disk first side is depressed into the deflated balloon wall and the wall covering the bore has a small hole or orifice make in it. The tube passes through the disk bore and wall orifice.

In an exemplary embodiment, the balloon wall is secured to the disk such that the balloon wall material surrounding the wall orifice remains elastic and forms a sliding seal against the tube upon passage therethrough.

In an alternate embodiment, the disk bore includes constriction rings that form a sliding seal against the tube and the balloon wall is secured and sealed against the disk.

The method of passing a tube in sealed relationship through a wall of an inflatable balloon comprises the steps of inserting the disk into a deflated balloon through the balloon neck, depressing the disk first side into the deflated balloon elastic wall such that a balloon wall portion covers the disk bore first end, securing the wall to the disk such that the balloon wall portion covering the disk bore essentially will not be expanded upon balloon inflation, making an orifice in the balloon wall portion covering the disk bore first end, and inserting the tube through the balloon wall orifice and disk bore. The step of securing the deflated balloon wall to the depressed disk includes applying a locking collar around the balloon adjacent the disk second side.

Other features and many attendant advantages of the invention will become more apparent upon a reading of the following detailed description together with the drawings in which like reference numerals refer to like parts throughout.

BRIEF DESCRIPTION OF THE DRAWING

FIG. 1 is a perspective view of an exemplary embodiment of the balloon display device of the present invention illustrating an inflated elastic balloon with a tube passing therethrough.

FIG. 2 is a partial perspective view of an exemplary embodiment of a tube balloon wall passage disk with tube passing therethrough.

FIG. 3 is a partial cross-sectional view of the tube wall passage disk and tube of FIG. 2 as installed in a balloon wall.

FIG. 4 is a partial cross-sectional view of a preferred embodiment of a tube wall passage disk as installed in a balloon wall.

FIG. 5 is a partial cross-section view of my prior art balloon neck gate-valve as mounted in a balloon filler neck.

FIG. 6 is a plane view of a multiple balloon display employing the teachings of the invention.

DETAILED DESCRIPTION OF THE INVENTION

With reference now to the drawings, and more particularly to FIG. 1 thereof, there is shown a perspective view of an exemplary embodiment of the balloon display device, denoted generally as 10, of the present invention. Display device 10 generally comprises a an inflated balloon, denoted generally as 20, and a tubs assembly, denoted generally as 50, including a tube 54 and tube balloon wall passage means, denoted generally as 70, for allowing tube 54 to pass in a sealed relationship completely through balloon 20.

Balloon 20 is of the common, readily available type comprising a wall 22 of elastically expansible material formed into a closed shape so as to define an expansion chamber 21. Balloon 20 includes a fill gas insertion neck portion 26, having a passage therethrough between an external gas insertion opening 27 and the expansion chamber for passage of inflation air. Neck 26 is shown tied in a sealing knot 28 after balloon inflation.

In the exemplary embodiment shown a wall passage member, tube 54, is a hollow cylinder and includes ends,, including first and second ends 55, 56 disposed outside of balloon 20 and mid-section 57 that passes through expansion chamber 21. In some instances, it is desirable that the wall passage member passes through only a singe wall of the balloon. In this case, the wall passage member must be a rod, instead of a tube. That is, it must be a member that will not allow gas to escape the balloon through the member's interior.

Tube wall passage means 70 includes a disk 71 mounted to balloon wall 22.

FIGS. 2 and 3 illustrate an exemplary embodiment of a tube wall passage disk, large bore disk 71*a*. FIG. 2 is a partial perspective view of large bore disk 71*a* with tube 54 passing therethrough. Large bore disk 71*a* has a first side 73*a*, a second side 75*a*, and a bore 77*a* therebetween for passage therethrough of tube 54. Bore 77*a* includes a first end 72 exiting disk first side 73 and a second end 74 exiting disk second side 75*a*. Bore 77*a* is larger than the tube outer diameter such that tube 54 freely passes through the bore 77*a*.

FIG. 3 is a partial cross-sectional view of large bore disk 71*a* and tube 54 of FIG. 2 as installed in balloon wall 22. To arrive at the mounted configuration of FIG.

3, disk 71*a* is depressed first side 73*a* first into balloon wall 22 of a deflated balloon. A portion 23 of balloon wall 22 covers disk first side 73*a*. securing means, such as locking collar 90, secures balloon wall 22 to disk 71*a* such that balloon wall disk covering portion 23 essentially is not expanded upon inflation of balloon 20. Locking collar 90 passes around balloon 20 adjacent disk second side 75*a* and retains disk 71*a* depressed into wall 22. Locking collar 90 may be an elastic band or other suitable tie. Other securing means are contemplated.

A small orifice 24 is made in balloon wall disk covering portion 23 at disk bore 77*a* to allow for passage therethrough of tube 54. Wall portion 23 remains elastic upon inflation of balloon 20 so that wall material surrounding orifice 24 seals against tube 54. This is a sliding seal as balloon 20 can be slid along tube 54 in a sealed relationship. A more durable sliding seal will be discussed with reference to FIG. 6.

On the other side of locking collar 90, balloon wall 22 expands greatly upon balloon inflation and thins considerably, as represented by inflated wall section 25.

In the embodiments of the invention illustrated, disk 71*a* or 71*b* is depressed into the deflated balloon wall 22 from inside balloon 20. This is done by passing disk 71*a* or 71*b* through neck 26. Disk 71*a* or 71*b* is depressed into wall 22 from the inside and collar 90 is applied. Orifice 24 can be made with any sharp object, such as a pin or burnt through with a heated object. By attaching two disks 71 to balloon 20 tube 54 can be passed completely through balloon 20.

FIG. 4 is a partial cross-sectional view of another and preferred embodiment of a tube wall passage means, including sealing bore disk 71*b* as installed in a balloon wall 22. The installation of sealing bore disk 71*b* is similar to that of large bore disk 71*a* in most respects. Sealing bore disk 71*b* includes a first side 78*b*, a second side 75*b*, and a bore 77*b* therebetween for passage therethrough of tube 54. However, bore 77*b* is adapted to form a sliding air-tight seal with tube 54. This is accomplished by inclusion in bore 77*b* of concentric constriction ring 78 that resiliently seals against tube 54. A pair of rings 78 are shown. The second ring 78 also adds to the rigidity of the tube mounting. Balloon wall 22 is secured to disk 71*b* by means, such as collar 90 such that balloon wall 22 seals against disk 71*b* such as at orifice 24 or where wall 22 is stretched over the disk periphery.

FIG. 5 is a partial cross-section view of my prior art balloon neck plug or gate-valve 92 as mounted in a balloon filler neck 26 as taught in U.S. Pat. No. 4,997,403. The elastic neck 26 seals about the periphery of gate-valve 92. Gate-valve 92 includes a bore 87 passing therethrough for access to the expansion chamber 21 and for passage of tube 54. Gate-valve bore 87 is adapted seal against tube 54 in a sliding air-tight sealed relationship. Gate-valve 92 was originally invented to provide means for introducing a rod with a light on the end thereof, i.e. a light stick, into a balloon and for positioning the light at any distance into the balloon. The light stick cannot allow passage of inflation gas through its interior. Gate-valve 92 can be applied to the present invention as a means for introducing tube 54 to expansion chamber 21 through neck 26 and only one wall disk 71 and orifice is needed to pass tube 54 completely through balloon 20.

FIG. 6 is a plane view of a multiple balloon display employing the teachings of the invention. Tubes 54 pass through balloons 20 and hold balloons 20 in desired relative positions. Balloons 20*f* have a gate valve 80 in neck 26 and a disk valve 71 diametrically located for passage of tube 54 therethrough. Balloon 20*g* additionally has a pair of disk valves 71*g* for passage of tube 54 through therethrough.

The invention allows balloons 20 to be shoved close together, as illustrated with balloons 20*g*, 20*h*, 20*i* to form a continuous balloon line such that only the balloons are visible.

Tube 54 may be used to conduct wiring or may contain elements, such as lights for illuminating the balloons 20 from within.

Having described the invention, it can be seen that it provides a very innovative device for displaying balloons.

Although particular embodiments of the invention have been illustrated and described, various changes may be made in the form, composition, construction, and arrangement of the parts without sacrificing any of its advantages. Therefore, it is to be understood that all matter herein is to be interpreted as illustrative and not in any limiting sense and it is intended to cover in the appended claims such modifications as come within the true spirit and scope of the invention.

Having described my invention, I now claim:

1. A balloon display device comprising:

an inflated elastic balloon including:

a wall of elastically expansible material formed into a closed shape so as to define an expansion chamber; and a rod assembly including:

a rod passing in sealed relationship through said inflated balloon; said rod including:

a first end outside of said balloon wall;

a second end outside of said balloon wall; and a mid-section passing through said expansion chamber;

said wall of elastically expansible material elastically sealing on said rod assembly; and rod wall passage means for passage of said rod in a sealed relationship through a balloon wall orifice including:

a disk depressed into said balloon wall including:

a first side;

a second side; and a bore therebetween for passage therethrough of said rod; said bore having:

a first end exiting said disk first side; and a second end exiting said disk second side; and wherein:

said balloon al includes a disk covering portion covering said disk first side including an orifice therethrough over said disk bore; said rod passing through said disk bore and through said balloon wall orifice; and securing means for securing said balloon wall to said disk such that said balloon wall disk bore covering portion essentially is not expanded upon balloon inflation such that said wall material surrounding said wall orifice remains elastic and seals against said rod upon passage therethrough.

2. The device of claim 1 wherein:

said securing means includes:

a locking collar around said balloon adjacent said disk second side.

3. A balloon display device comprising:

an inflated elastic balloon including:

a wall of elastically expansible material formed into a closed shape so as to define an expansion chamber; and a rod assembly including:

a rod passing in sealed relationship through said inflated balloon; said rod including:

a first end outside of said balloon wall;

a second end outside of said balloon wall; and a mid-section passing through said expansion chamber; said wall of elastically expansible material elastically sealing on said rod assembly; and rod wall passage means for passage of said rod in a sealed relationship through a balloon wall orifice that is not a necked-down gas insertion orifice including:

a disk depressed into said balloon wall including:

a first side;

a second side; and a bore therebetween for passage therethrough of said rod; said bore adapted to form an air-tight seal with said rod; said bore having:

a first end exiting said disk first side; and a second end exiting said disk second side; and wherein:

said balloon wall includes a disk covering portion covering said disk first side including an orifice therethrough over said disk bore; said rod passing through said disk bore and through said balloon wall orifice; and securing means for securing said balloon wall to said disk such that said balloon wall disk covering portion seals against said disk.

4. The device of claim 3 wherein:

said securing means includes:

a locking collar around said balloon adjacent said disk second side.

5. A balloon display device comprising:

an inflated elastic balloon including:

a wall of elastically expansible material formed into a closed shape so as to define an expansion chamber; and a gas insertion neck portion including a neck; and a rod assembly including:

a rod passing in sealed relationship through said inflated balloon; said rod including:

a first end outside of said balloon wall;

a second end outside of said balloon wall; and a mid-section passing through said expansion chamber; said wall of elastically expansible material elastically sealing on said rod assembly;

a plug inside said balloon neck adapted to form a seal between said plug and said balloon neck and having a bore therethrough for access to the interior of said balloon; said plug bore adapted to form an air-tight seal with said rod near said rod first end;

rod wall passage means for passage of said rod in a sealed relationship through a balloon wall orifice including:

a disk depressed into said balloon wall including:

a first side;

a second side; and a bore therebetween for passage therethrough of said rod; said bore having:

a first end exiting said disk first side; and a second end exiting said disk second side; and wherein:

said balloon wall includes a disk covering portion covering said disk first side including an orifice therethrough over said disk bore; said rod passing through said disk bore and through said balloon wall orifice; and securing means for securing said balloon wall to said disk such that said balloon wall disk covering portion essentially was not expanded upon balloon inflation such that said wall material surrounding said wall orifice remains elastic and seals against said rod upon passage therethrough.

6. The device of claim 5 wherein:

said securing means includes:

a locking collar around said balloon adjacent said disk second side.

7. A balloon display device comprising:

an inflated elastic balloon including:

a wall of elastically expansible material formed into a closed shape so as to define an expansion chamber; and a gas insertion neck portion including a neck; and a rod assembly including:

a rod passing in sealed relationship through said inflated balloon; said rod including:

a first end outside of said balloon wall;

a second end outside of said balloon wall; and a mid-section passing through said expansion chamber; said wall of elastically expansible material elastically sealing on said rod assembly;

a plug inside said balloon neck adapted to form a seal between said plug and said balloon neck and having a bore therethrough for access to the interior of said balloon; said plug bore adapted to form an air-tight seal with said rod near said rod first end;

rod wall passage means for passage of said rod in a sealed relationship through a balloon wall orifice including:

a disk depressed into said balloon wall including:

a first side;

a second side; and a bore therebetween for passage therethrough of said rod; said bore adapted to form an air-tight seal with said rod; said bore having:

a first end exiting said disk first side; and a second end exiting said disk second side; and wherein:

said balloon wall includes a disk covering portion covering said disk first side including an orifice therethrough over said disk bore; said rod passing through said disk bore and through said balloon wall orifice; and securing means for securing said balloon wall to said disk such that said balloon wall disk covering portion seals against said disk.

8. The device of claim 7 wherein:

said securing means includes:

a locking collar around said balloon adjacent said disk second side.

9. A balloon display device comprising:

an inflated elastic balloon including:

a wall of elastically expansible material formed into a closed shape so as to define an expansion chamber; and a sealed gas insertion opening in said wall; and a rod assembly including:

a rod passing in sealed relationship through said wall of said inflated balloon apart from said gas insertion opening; said rod including:

a first end outside of said balloon wall;

a second end within said expansion chamber; and wherein:

said rod assembly further includes:

rod wall passage means for passage of said rod in a sealed relationship through a balloon wall orifice including:

a disk depressed into said balloon wall including:

a first side;

a second side; and a bore therebetween for passage therethrough of said rod; said bore having:

a first end exiting said disk first side; and a second end exiting said disk second side; and said balloon wall includes a disk covering portion covering said disk first side including an orifice therethrough over said disk bore; said rod passing through said disk bore and through said balloon wall orifice; and securing means for securing said balloon wall to said disk such that said balloon wall disk bore covering portion essentially was not expanded upon balloon inflation such that said wall material surrounding said wall orifice remains elastic and seals against said rod upon passage therethrough.

10. A balloon display device comprising:

an inflated elastic balloon including:

a wall of elastically expansible material formed into a closed shape so as to define an expansion chamber; and a sealed gas insertion opening in said wall; and a rod assembly including:

a rod passing in sealed relationship through said wall of said inflated balloon apart from said gas insertion opening; said rod including:

a first end outside of said balloon wall;

a second end within said expansion chamber; and wherein:

said rod assembly further includes:

rod wall passage means for passage of said rod in a sealed relationship through a balloon wall orifice including:

a disk depressed into said balloon wall including:

a first side;

a second side; and a bore therebetween for passage therethrough of said rod; said bore adapted to form an air-tight seal with said rod;

said bore having:

a first end exiting said disk first side; and a second end exiting said disk second side; and said balloon wall includes a disk covering portion covering said disk first side including an orifice therethrough over said disk bore; said rod passing through said disk bore and through said balloon wall orifice; and securing means for securing said balloon wall to said disk such that said balloon wall disk covering portion seals against said disk.

11. A method of passing a rod in sealed relationship through a wall of an inflatable balloon comprising the step of:

obtaining a deflated balloon having an elastic wall formed into a closed shape surrounding an expansion chamber;

obtaining a rod;

obtaining a disk having a first side, a second side, and a bore therebetween for passage therethrough of the rod; the bore having a first end exiting the disk first side, and a second end exiting the disk second side;

depressing the disk, disk first side first, into the deflated balloon elastic wall such that a balloon wall portion covers the disk bore first end;

securing the deflated balloon wall to the depressed disk such that the balloon wall portion covering the disk bore first end essentially will not be expanded upon balloon inflation;

making an orifice in the balloon wall portion covering the disk bore first end; the orifice being of size such that the balloon wall surrounding said orifice will seal against the rod upon passage of the rod therethrough; and inserting the rod through the balloon wall orifice.

12. The method of claim 11 wherein:

the obtained balloon includes an elastic filler neck; and further including the step of:

inserting the disk through the balloon elastic filer neck into the expansion chamber before depressing the disk into the balloon wall.

13. The method of claim 11 wherein:

the step of securing the deflated balloon wall to the depressed disk includes:

applying a locking collar around the balloon adjacent the disk second side.

14. A method of passing a rod in sealed relationship through a wall of an inflatable balloon comprising the step of:

obtaining a deflated balloon having an elastic wall formed into a closed shape surrounding an expansion chamber;

obtaining a rod;

obtaining a disk having a first side, a second side, and a bore therebetween for passage therethrough of the rod; the bore adapted to form an air-tight seal with the rod; the bore having a first end exiting the disk first side, and a second end exiting the disk second side;

depressing the disk, disk first side first, into the deflated balloon elastic wall such that a balloon wall portion covers the disk bore first end;

securing the deflated balloon wall to the depressed disk such that the balloon wall seals against the disk;

making an orifice in the balloon wall portion covering the disk bore first end for passage of the rod therethrough; and inserting the rod through the balloon wall orifice and the disk bore.

15. The method of claim 14 wherein:

the obtained balloon includes an elastic filler neck; and further including the step of:

inserting the disk through the balloon elastic filer neck into the expansion chamber before depressing the disk into the balloon wall.

16. The method of claim 14 wherein:

the step of securing the deflated balloon wall to the depressed disk includes:

applying a locking collar around the balloon adjacent the disk second side.

17. A method of passing a rod in sealed relationship through an inflatable balloon having an elastic filler neck includes the step of:

obtaining a deflated balloon having an elastic wall formed into a closed shape surrounding an interior expansion chamber and having an elastic filler neck;

obtaining a rod;

obtaining a disk having a first side, a second side, and a bore therebetween for passage therethrough of the rod; the bore having a first end exiting the disk first side, and a second end exiting the disk second side;

depressing the disk, disk first side first, into the deflated balloon elastic wall such that a balloon wall portion covers the disk bore first end;

securing the deflated balloon wall to the depressed disk such that the balloon wall portion covering the disk bore first end essentially will not be expanded upon balloon inflation;

making an orifice in the balloon wall portion covering the disk bore; the orifice being of size such that the balloon wall surrounding said orifice will seal against the rod upon passage of the rod therethrough;

inserting a plug into the elastic filler neck of the deflated balloon; the plug adapted to form an air-tight seal between the plug and the balloon neck and having a bore therethrough for access to the balloon interior expansion chamber; the plug bore adapted to form an air-tight seal with a rod;

inserting the rod through the balloon orifice, the disk bore and the plug bore.

18. The method of claim 17 wherein:

the step of securing the deflated balloon wall to the depressed disk includes:

applying a locking collar around the balloon adjacent the disk second side.

19. A method of passing a rod in sealed relationship through an inflatable balloon having an elastic filler neck includes the step of:

obtaining a deflated balloon having an elastic wall formed into a closed shape surrounding an interior expansion chamber and having an elastic filler neck;

obtaining a rod;

obtaining a disk having a first side, a second side, and a bore therebetween for passage therethrough of the rod; the bore adapted to form an air-tight seal with the rod; the bore having a first end exiting the disk first side, and a second end exiting the disk second side;

depressing the disk, disk first side first, into the deflated balloon elastic wall such that a balloon wall portion covers the disk bore first end;

securing the deflated balloon wall to the depressed disk such that the balloon wall seals against the disk;

making an orifice in the balloon wall portion covering the disk bore first end for passage of the rod therethrough;

inserting a plug into the elastic filler neck of the deflated balloon; the plug adapted to form an air-tight seal between the plug and the balloon neck and having a bore therethrough for access to the balloon interior expansion chamber; the plug bore adapted to form an air-tight seal with a rod;

inserting the rod through the balloon orifice, the disk bore and the plug bore.

20. The method of claim 19 wherein:

the step of securing the deflated balloon wall to the depressed disk includes:

applying a locking collar around the balloon adjacent the disk second side.

* * * * *